US005240430A

United States Patent [19]

Soes

[11] Patent Number: 5,240,430

[45] Date of Patent: Aug. 31, 1993

[54] ELECTRICAL CONNECTOR FOR CABLE TO CIRCIT BOARD APPLICATION

[75] Inventor: Lucas Soes, Rosmalen, Netherlands

[73] Assignee: AMP Incorporated, Harrisburg, Pa.

[21] Appl. No.: 954,132

[22] Filed: Sep. 30, 1992

[30] Foreign Application Priority Data

Oct. 31, 1991 [NL] Netherlands ..... 9123104

[51] Int. Cl.[5] ..... H01R 13/00

[52] U.S. Cl. ..... 439/260; 439/495

[58] Field of Search ..... 439/259, 260, 263, 264, 439/493, 495

[56] References Cited

U.S. PATENT DOCUMENTS 4,519,133 5/1985 Pansanel ..... 439/260

FOREIGN PATENT DOCUMENTS 385314 9/1990 European Pat. Off. .

420009 4/1991 European Pat. Off. .

53-124793 10/1978 Japan .

89/06447 7/1989 PCT Int'l Appl. .

*Primary Examiner*—Joseph H. McGlynn

*Attorney, Agent, or Firm*—Adrian J. LaRue; Timothy J. Aberle

[57] ABSTRACT

An electrical connector 10, for connecting individual conductors 27 of an electrical cable 28 to a printed circuit board 11, comprises electrical terminals 26 and a similarly constructed electrical terminal 50. The electrical terminal is characterized in that it has an actuator arm 32 having a first leg portion 36, a second leg portion 38, a third leg portion 40 and a joining portion 42 joining the first, second and third leg portions 36, 38 and 40. An actuator 22 is positioned in an actuation area 44 between engaging surfaces **36*a* and 38*a* which causes the electrical terminal 26 to be positioned in a home position in the insulating housing 12. As the actuator 22 is moved further into an actuation area 44, the engaging surfaces 38*b* and 40*a* move into pinched engagement with the conductor 26 of the cable 28**.

10 Claims, 9 Drawing Sheets 28
27
10
22
26
2
23
14
12d
12
2
12b
13
12c
30b
16
12a
52b
50
11a
11-2

22
24a
38a
28
23
10
24b
38
40a
36a
30a
27
18
31
14
30
14
38b
24
44
40
12b
36
48
12
26
12a
32
30c
20
34
16
42
16
30b 10
28
40a
38a
38
38b
24b
22
24a
40
30a
36a
31
18
30
14
14
27
44
40
36
12b
48
12
24
12a
26
32
30c
20
34
42
16
16
30b

ELECTRICAL CONNECTOR FOR CABLE TO CIRCIT BOARD APPLICATION

This invention relates to an electrical connector for connecting individual conductors of an electrical cable to a printed circuit board.

Electrical connectors having the capability of interconnecting individual conductors to circuit traces of printed circuit boards exist in the electronics industry. These connectors are mounted onto the circuit board having electrical terminals exposed at a lower edge thereof which make electrical contact with the traces on the circuit board. Electrical connectors also have electrical terminals which accept conductors, for example, of a multi-conductor flat or foil cable, in an electrically conducting manner. One electrical connector in particular includes an electrical terminal housing having through passageways for electrical terminals. The housing has a lower face which mounts approximate to the circuit board and an upper face which accepts a multiconductor cable. The electrical terminals are placed in respective passageways within the connector housing with printed circuit board posts extending beyond the lower face, and cable receiving portions of the terminals disposed proximate to the upper face. The housing also includes a camming member which is movable to open the cable receiving portion of the terminal to accept the cable in a zero insertion force fashion. Release of the camming member returns the camming member to an undeflected position and into contact with the cable.

EPO Patent No. 385,314 A1 discloses an electrical connector comprising a housing having an upper face and a plurality of conductor receiving openings therein. The upper face of the housing and the openings are fixed relative to a camming member of the electrical connector. The camming member is movable relative to the housing and the upper face whereby, when the camming member is moved to actuate and release the conductor receiving portions of the terminals, the upper face remains fixed relative to the camming member.

In EPO 420,009 A1, an electrical connector is shown comprising an insulating housing having a first conductor receiving face with at least one opening profiled for the receipt of a first conductor. The opening is in communication with a terminal receiving cavity having at least one electrical terminal disposed therein. The electrical terminal has two contact arms extending upwardly from a base section which is spring loaded upwardly under the influence of spring means. The spring means causes the two contact arms to be in engagement with sloped surfaces associated with the terminal receiving cavity. The spring biased base section is movable, relative to the terminal receiving cavity, from an upward wire engagement position to a lower wire receiving position.

A disadvantage of the above-mentioned connectors is that the electrical terminal in the connectors often become misaligned with the terminal receiving openings, thereby making it difficult to insert the cable in the connector. Another problem with some of the prior art electrical terminals is that they typically had one arm anchored and another arm actuated to move towards and away from the anchored arm so that the flat cable could be inserted therebetween. It was not uncommon for one of the arms to fail to engage the conductor on the flat cable, particularly if the flat cable was not properly positioned between the arms. These problems resulted in a poor electrical connection between the conductors of the cable and the electrical terminals.

An object of this invention is to design an electrical connector having means for aligning an electrical terminal in a terminal receiving opening and which has conductive arms which are actuated into pinched engagement with a conductor of a cable.

Another object of this invention is to provide an electrical terminal which comprises an actuator arm having a pair of contact arms which can be simultaneously actuated into conductive engagement with the conductors of a flat cable.

In one aspect of the invention, this invention comprises an electrical terminal for use in an electrical connector for connecting at least one conductor from a foil cable to a circuit; said electrical terminal comprising: a base arm; and an actuator arm resiliently coupled to said base arm; said actuator arm comprising a first leg portion, a second leg portion, a third leg portion and a joining portion joining said first, second and third leg portions; said second and third leg portions defining an insertion area for receiving the foil cable; said first and second leg portions defining an actuator area for receiving an actuator; said second leg portion being resilient so that upon inserting said actuator into said insertion area said first and second portions are urged apart and said second and third portions are urged towards each other and into engagement with the at least one conductor of the foil cable.

In another aspect of the invention, this invention comprises an electrical terminal comprising an end for connecting to the circuit, said electrical terminal also comprising a first set of legs and a second set of legs arranged such that an actuator can actuate said first set of legs, thereby causing said second set of legs to move into pinched conductive engagement with a conductor of the cable.

The electrical connector will now be described with relation to the drawings, where:

Figure 1:
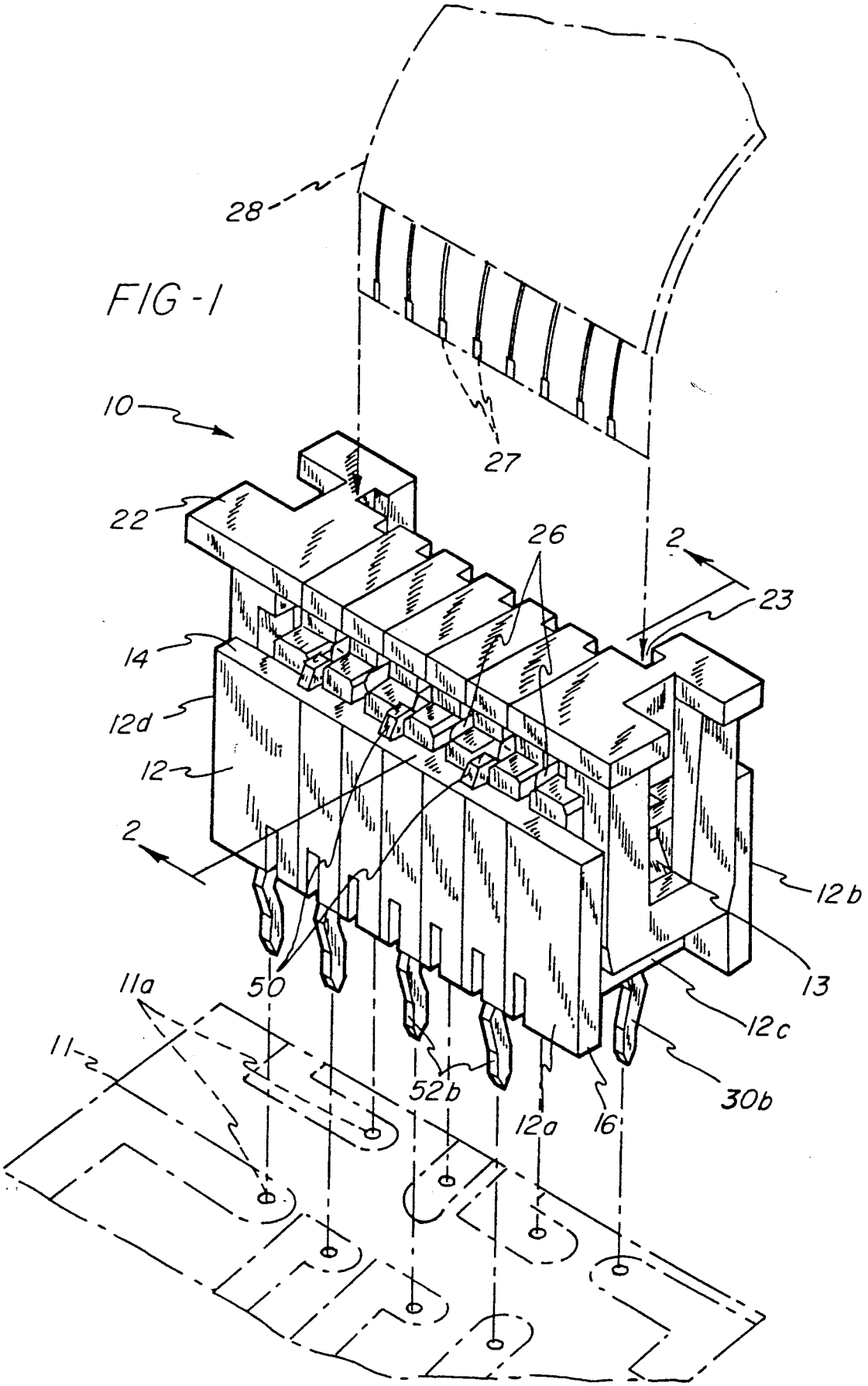
FIG. 1 is a perspective view of an electrical connector according to a preferred embodiment of this invention.
Figure 9:
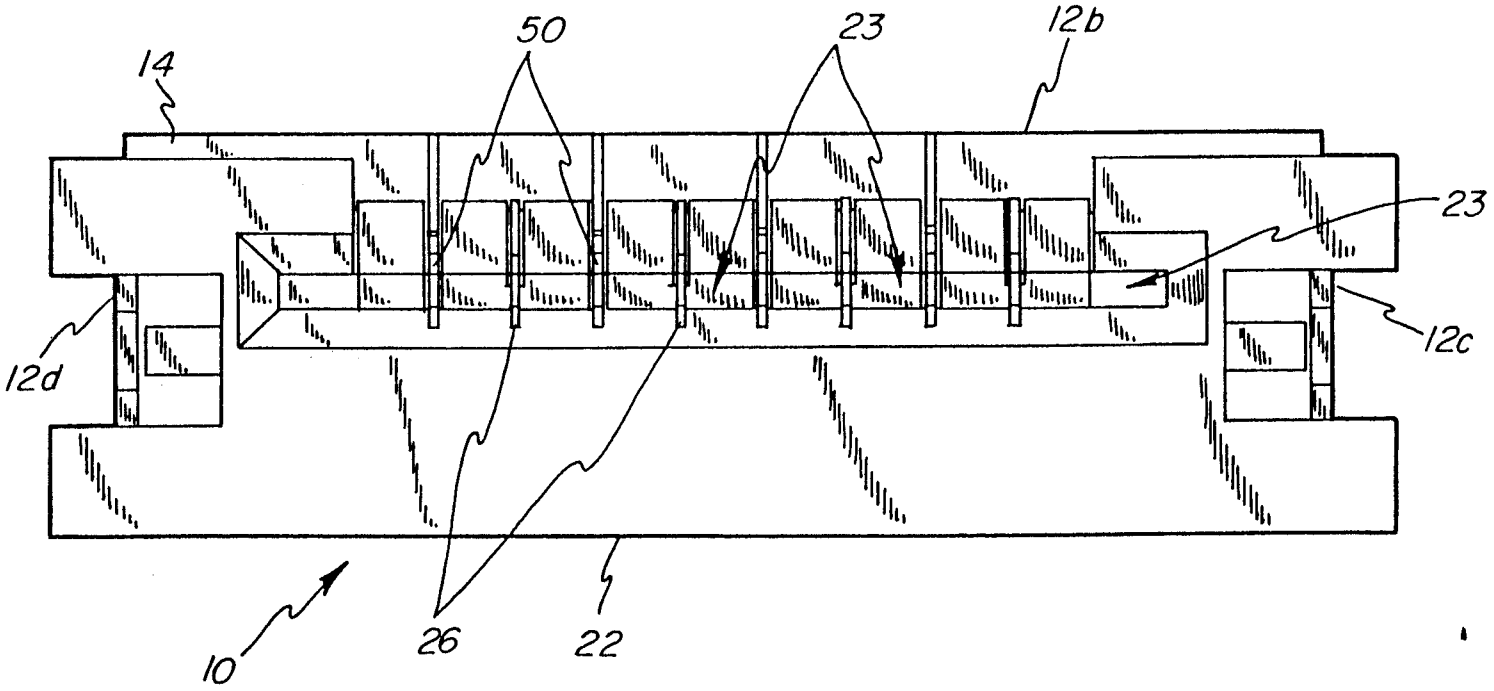
FIG. 9 is a top view of the electrical connector shown in FIG. 1.

FIG. 1 is a perspective view of an electrical connector, hereinafter designated electrical connector 10, made according to the present invention. The electrical connector 10 comprises an insulated housing 12 having an upper face 14 and a mounting face 16. The insulating housing 12 has a first wall 12*a*, a second wall 12*b*, an end wall 12*c* and an end wall 12*d* (FIG. 9). The insulating housing also comprises a plurality of terminal receiving passageways 18 (FIGS. 2–5) which open onto the upper face 14. Each terminal receiving passageway 18 comprises a press-fit opening 20 through in the mating face 14 which opens onto the mounting face 16 as shown.

The electrical connector 10 also comprises a vertically slidable (as viewed in FIG. 1) cap or actuator 22 having a camming portion 24 (FIGS. 2–5). The camming portion 24 comprises a first camming surface 24*a* and a second camming surface 24*b*. The actuator 22 is conventionally slidably secured to the insulating housing 12, for example, by resilient latches 13 on the end walls 12*c* and 12*d*.

With reference to FIGS. 2 through 6, the electrical connector 10 also comprises a plurality of electrical terminals 26 and electrical terminals 50 which are received in the terminal receiving passageways 18. The terminals 26 and 50 are alternatively positioned in the housing to stagger the printed circuit board posts 30*b* and 52*b* which extend downwardly there from. The function of each electrical terminal 26 and 50 is to electrically connect at least one conductor 27 from a cable 28 (FIG. 1) to a circuit (not shown) on a circuit board 11. In the embodiment being described, the cable 28 is a foil or flat flex cable, and each electrical terminal 26 and 50 is conventionally edge stamped from a conductive material.

Figure 2:
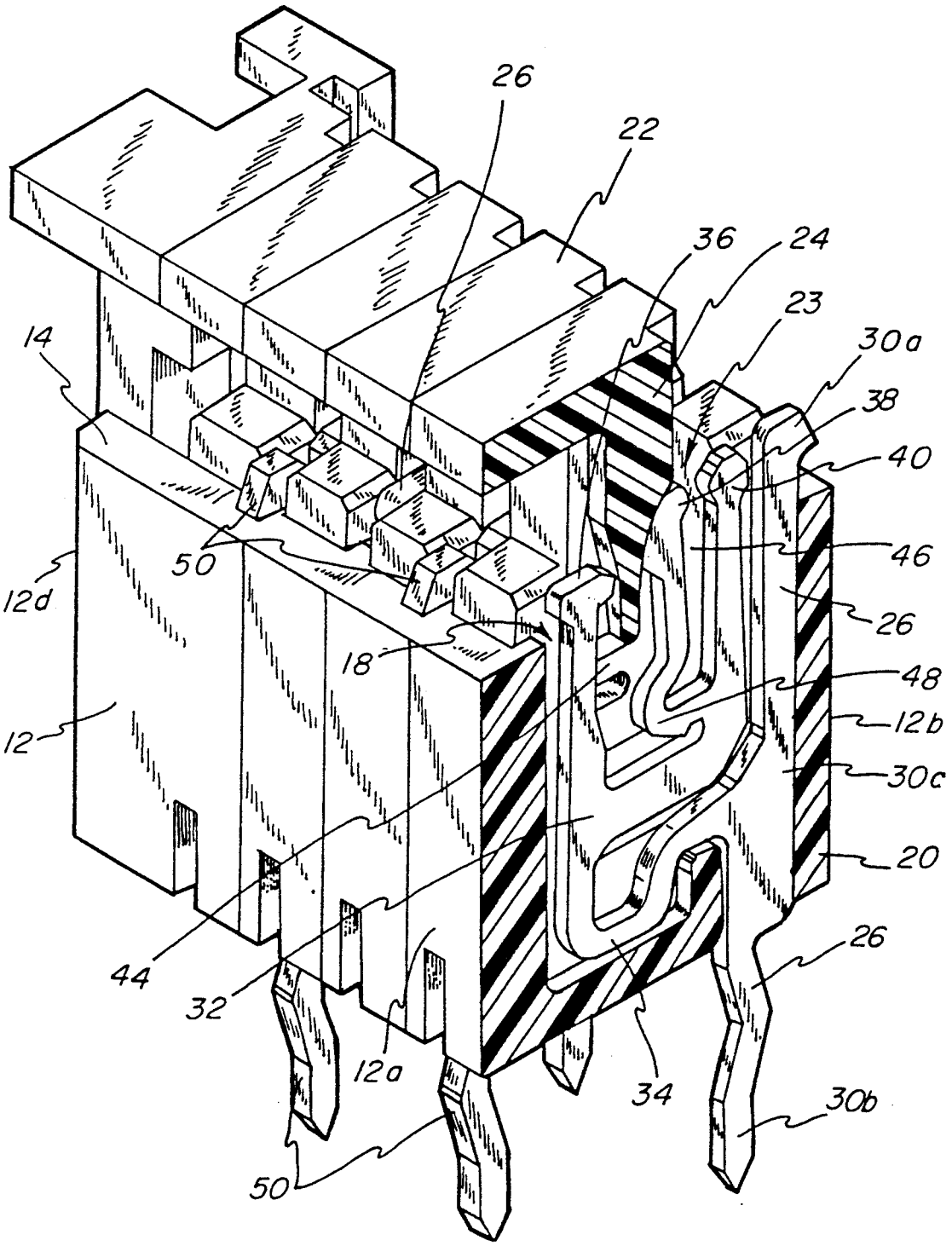
FIG. 2 is a cross-sectional view, taken along the line 2—2 in FIG. 1, showing an electrical terminal mounted in a terminal receiving passageway in the electrical connector.
Figure 3:
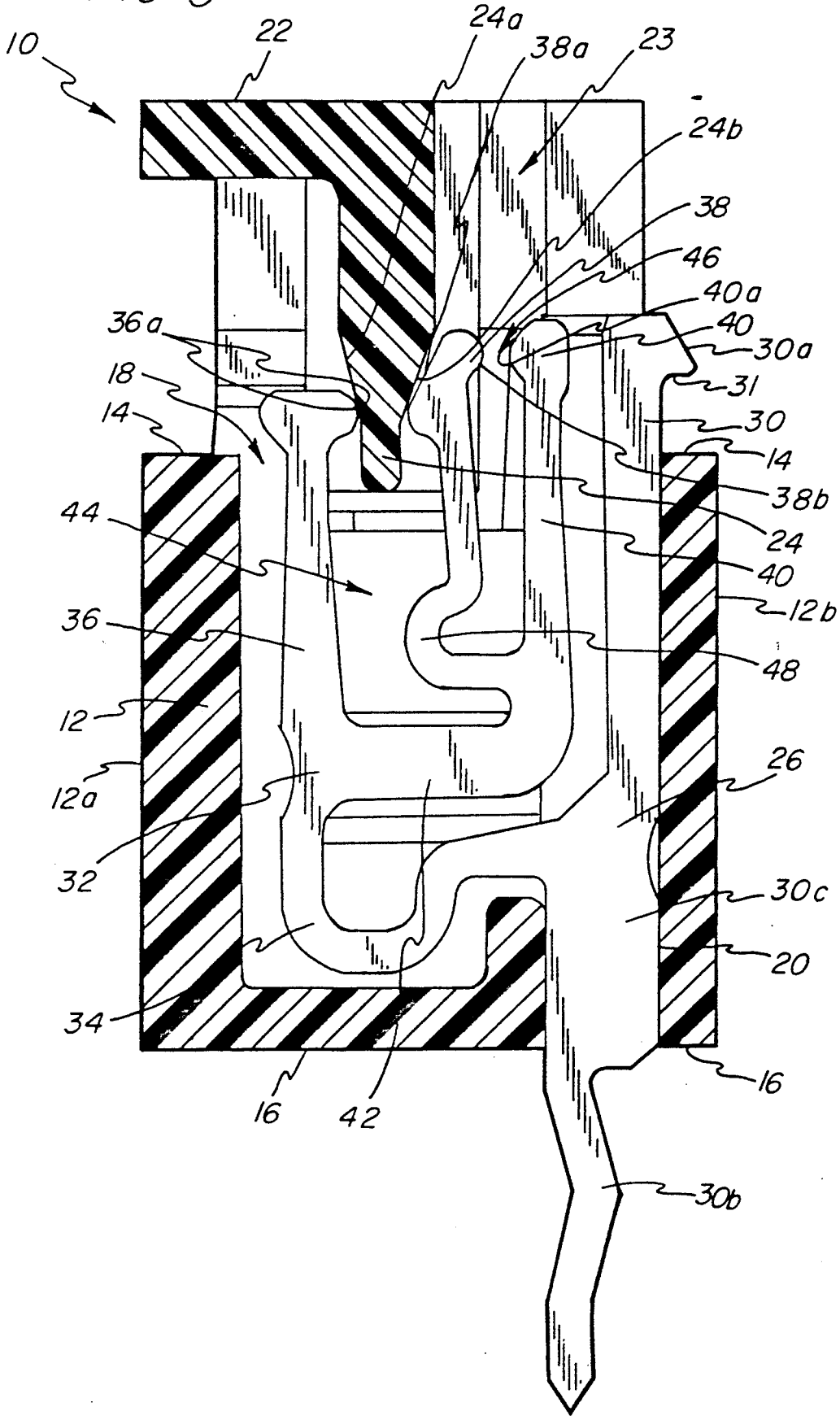
FIG. 3 is a cross-sectional end view, showing an actuator in operative relationship between a first leg portion and a second leg portion of a resilient actuator arm.
Figure 4:
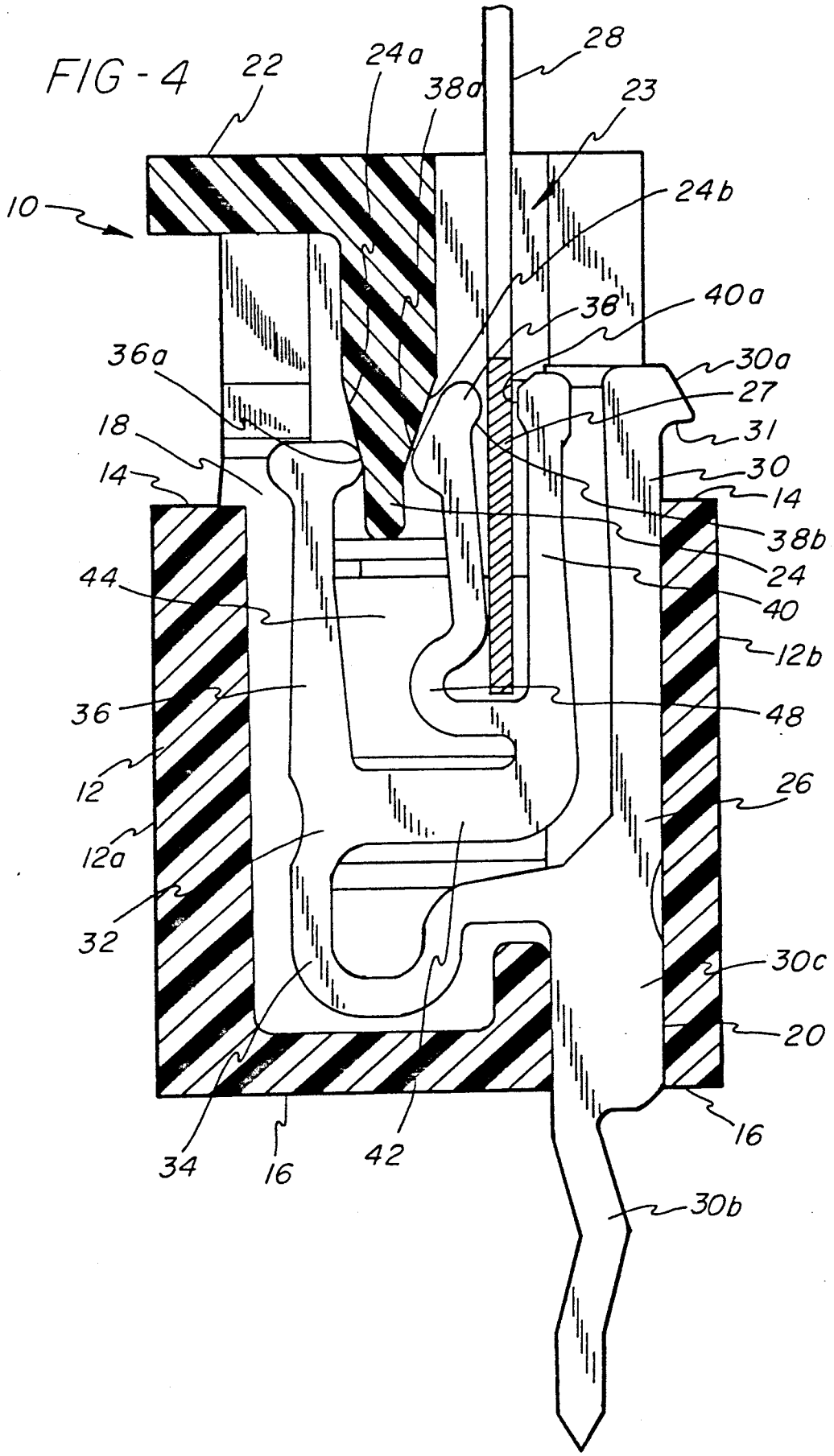
FIG. 4 is a cross-sectional end view similar to that of FIG. 3, showing a flat cable inserted in an insertion area between the second leg portion and a third leg portion.
Figure 5:
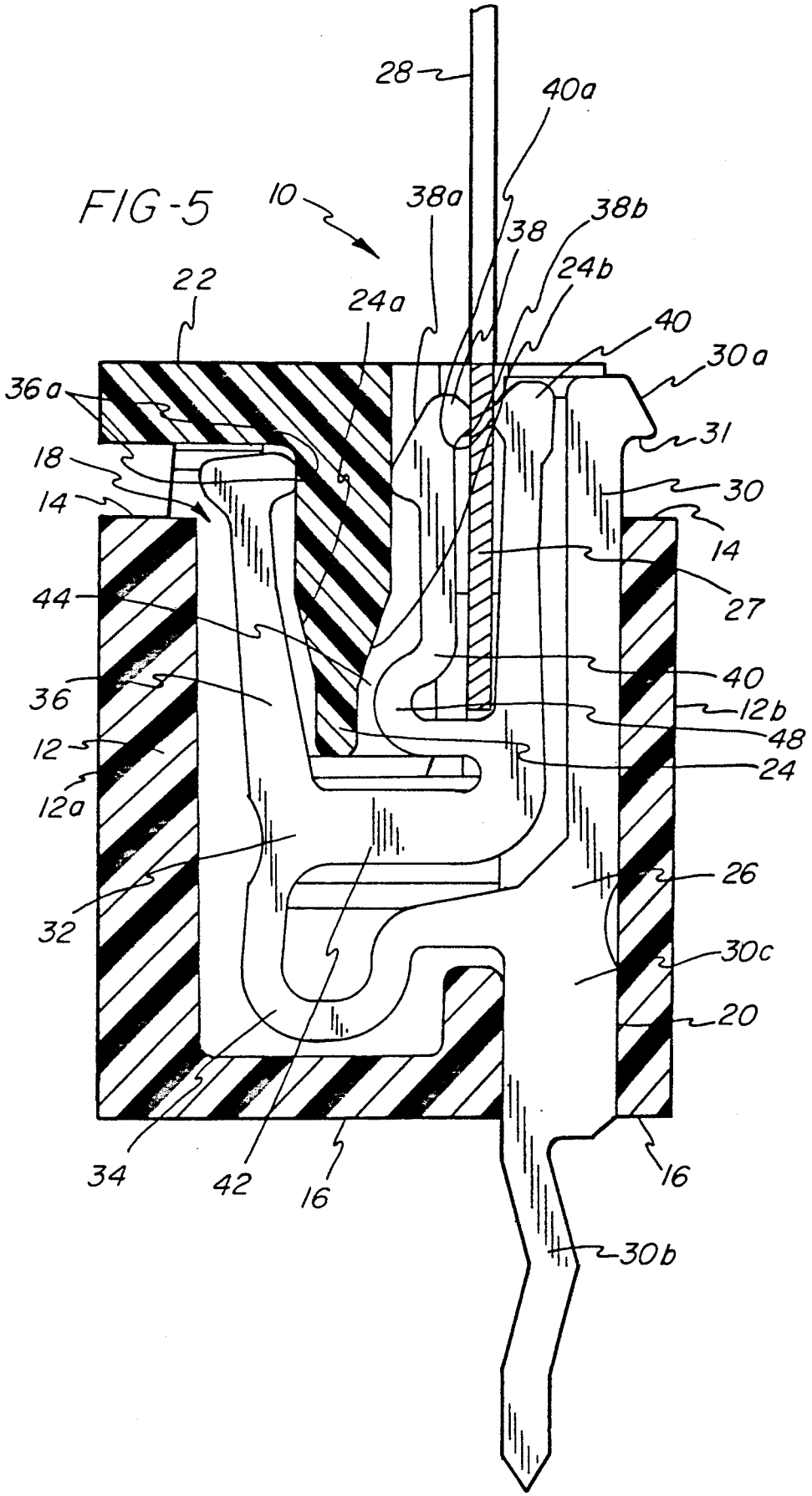
FIG. 5 is a cross-sectional view similar to that of FIGS. 3 and 4, showing the actuator in a fully actuated position so that the second and third leg portions are in pinched conductive engagement with the conductor of flat cable.
Figure 6:
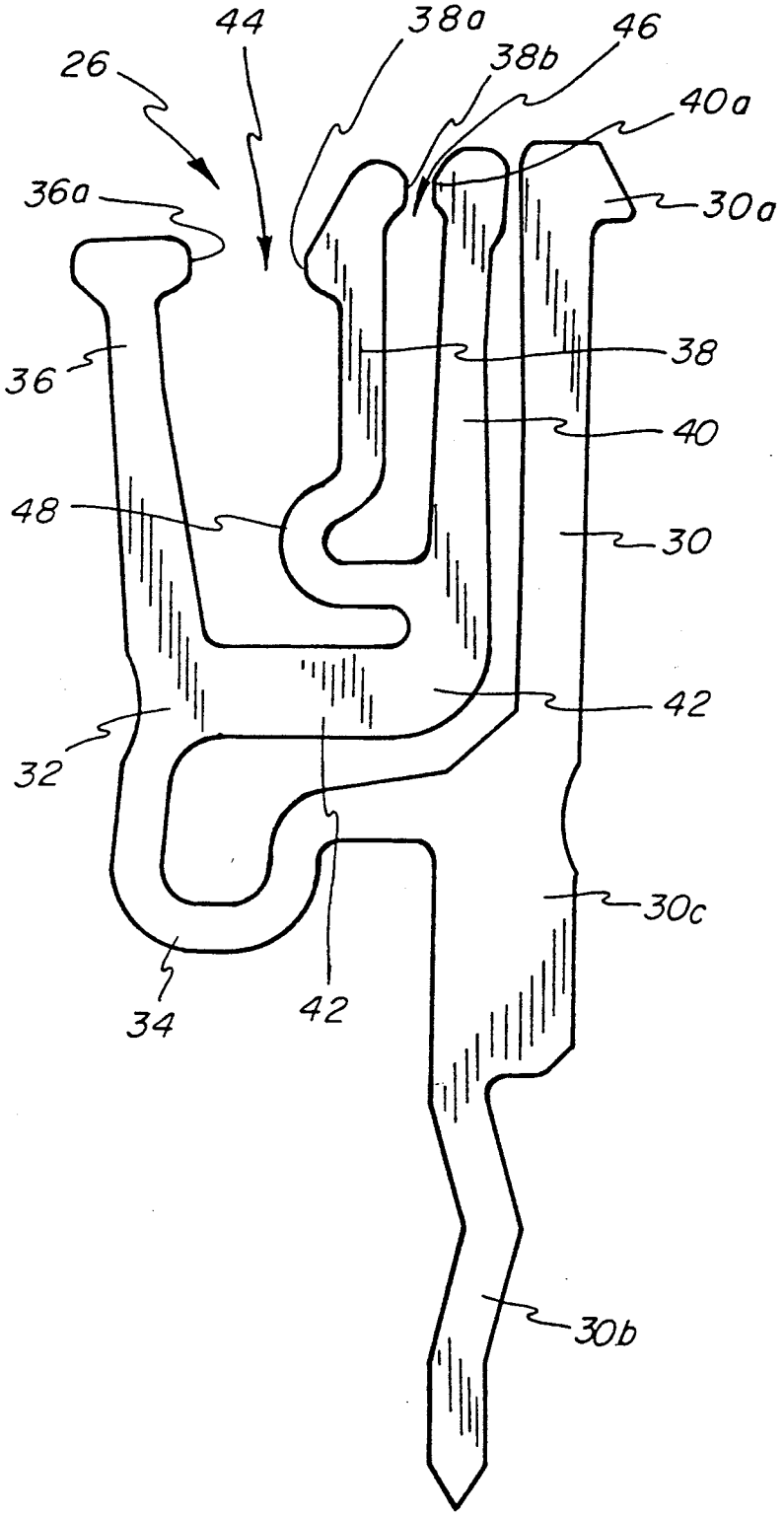
FIG. 6 is a plan view of the electrical terminal.

As best shown in FIG. 6, each electrical terminal 26 comprises a base arm 30 having a first end 30*a* and a solder leg or second end 30*b* which is soldered to the circuit board 29. As shown in FIG. 3, the second end 30*b* extends beyond the mounting face 16 when the electrical terminal 26 is mounted in the housing 12. As best shown in FIGS. 3–5, the base arm 30 has an enlarged section 30*c* which permits the electrical terminal 26 to be inserted into a terminal receiving passageway 18 and press-fit into the press-fit opening 20. The electrical terminal 26 also comprises an actuator arm 32 which is resiliently coupled to the base arm 30 by a spring section 34. The actuator arm 32 comprises a first leg portion 36, a second leg portion 38, a third leg portion 40 and a joining portion 42 for joining the first, second and third leg portions 36, 38, and 40. The second leg portion 38 is coupled to the joining portion 42 by a second spring section 48 as shown. The second spring section 48 permits the second leg portion 38 to be biased towards and away from the third leg portion 40. As best shown in FIG. 6, the first and second leg portions 36 and 38 define an actuator area 44 for receiving the camming portion 24. The second and third leg portions 38 and 40 define an insertion area 46 for receiving the cable 28. As shown in FIGS. 2, 3 and 6, the second and third leg portions 38 and 40 are normally in the open position. The first leg portion 36 has an engaging surface 36*a*, the second leg portion 38 has engaging surfaces 38*a* and 38*b*, and the third leg portion 40 has an engaging surface 40*a*. The function and operation of the engaging surfaces 36*a*, 38*a*, 38*b* and 40*a* will be described later herein.

Figure 7:
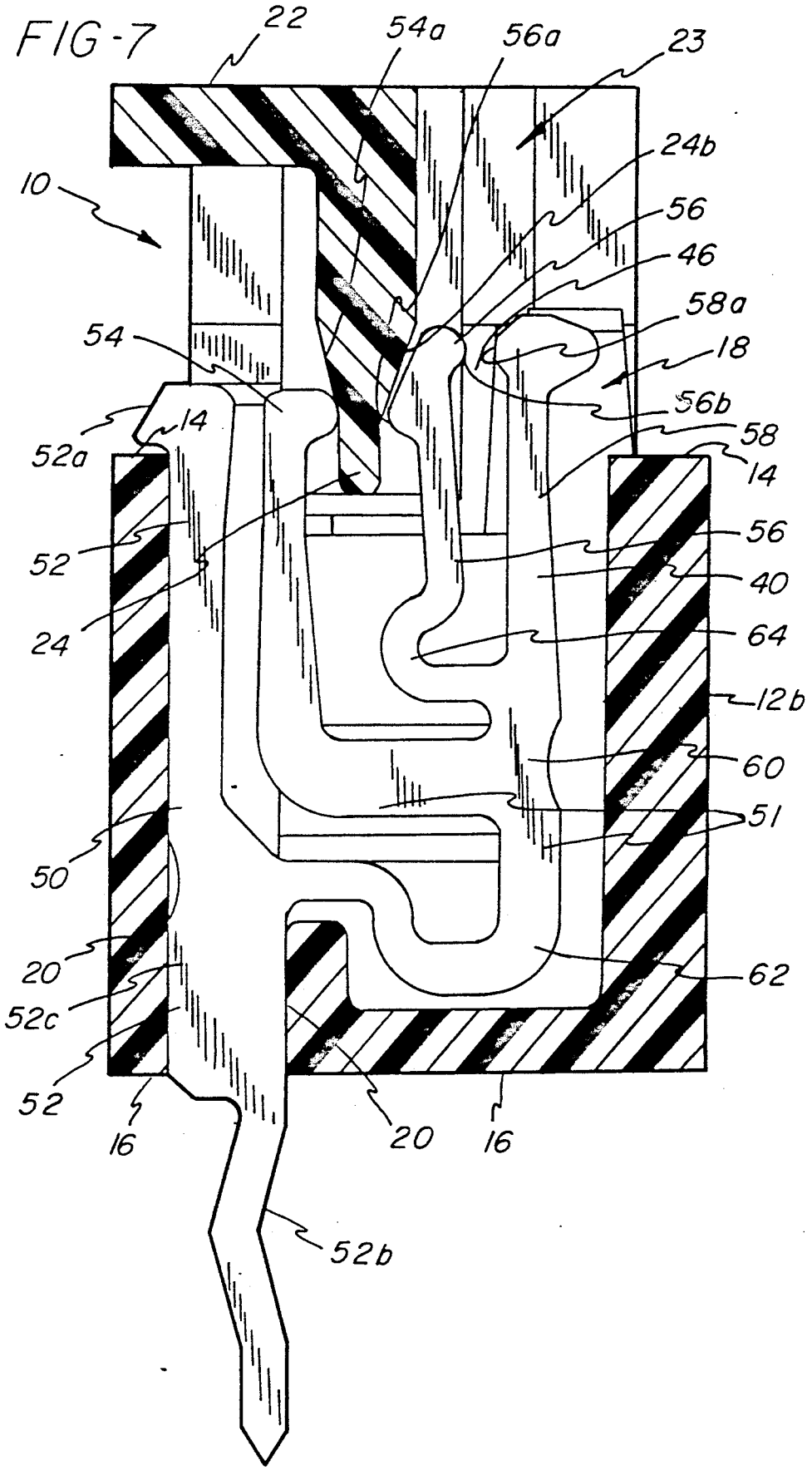
FIG. 7 is a cross-sectional view, showing the next adjacent electrical terminal used in the electrical connector.
Figure 8:
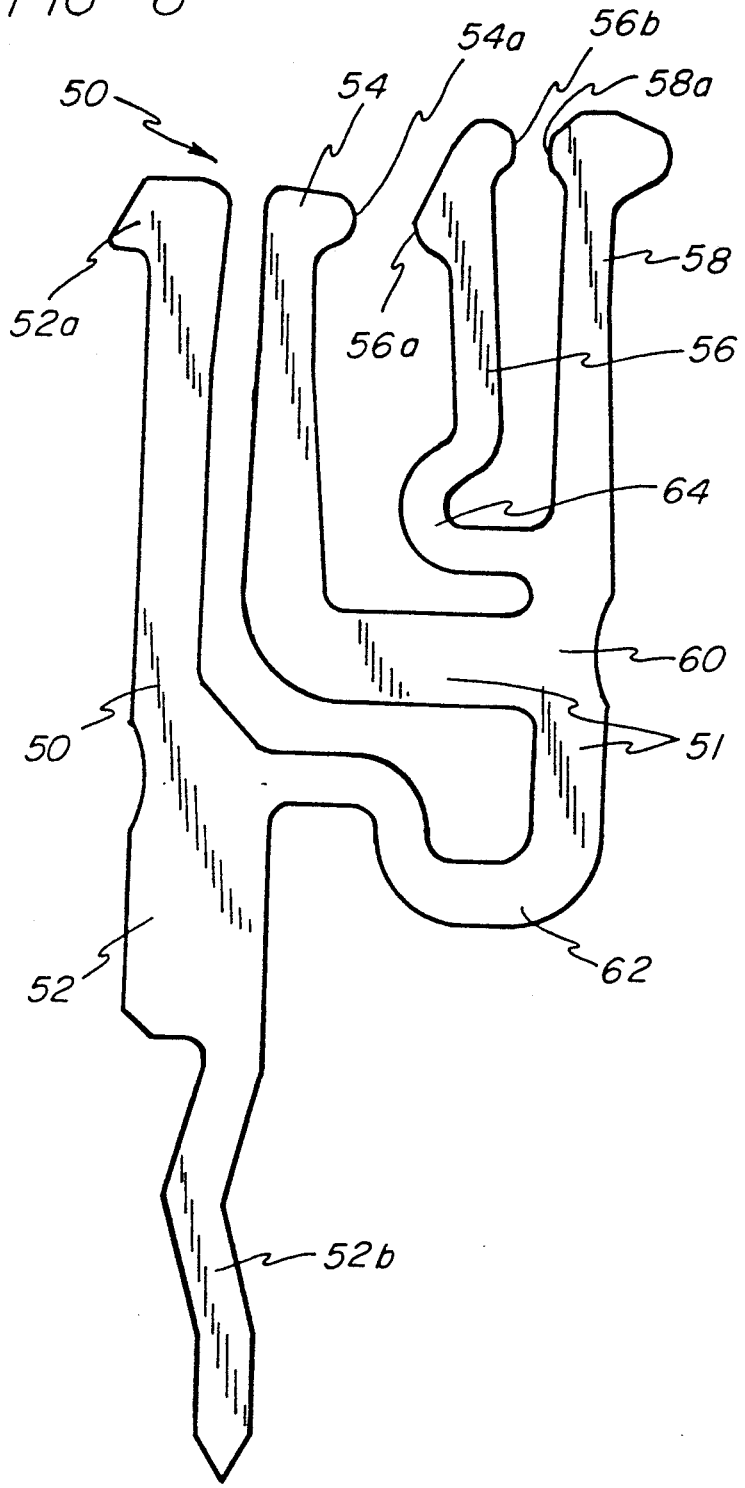
FIG. 8 is a plan view of the electrical terminal shown in FIG. 7.

The electrical connector 10 also comprises alternatively positioned electrical terminals 50 (FIGS. 7 and 8), as mentioned previously herein. Each electrical terminal 50 comprises an actuator arm 51, a base arm 52, a first leg portion 54, a second leg portion 56, a third leg portion 58, a joining portion 60 engaging surfaces 54*a*, 56*a*, 56*b*, and 58*a*, a spring section 62 and a second spring section 64 which function and operate substantially the same as the first leg portion 36, second leg portion 38, third leg portion 40, joining portion 42, engaging surfaces 36*a*, 38*a*, 38*b*, and 40*a*, spring section 34, and second spring section 48, respectively, of the electrical terminal 26. It is to be noted that the base arm 52 is situated adjacent to a first leg portion 54 of the electrical terminal 50, whereas the base arm 30 of the electrical terminal 26 is located adjacent the third leg portion 40. As best shown in FIG. 7, the base arm 52 of electrical terminal 50 comprises a first end 52*a* which abuts the upper face 14 when the electrical terminal 50 is mounted in the insulating housing 12. The base arm 52 comprises a solder arm or second end 52*b* which extends below (as viewed in FIG. 7) the mounting face 16 of the insulating housing 12. The base arm 52 has an enlarged section 52*c* which can be inserted to secure the electrical terminal 50 in the terminal receiving passageway 18.

The assembly of the electrical connector 10 will now be described. In the embodiment being described, every other terminal receiving passageway 18 has a press-fit opening 20 located adjacent to the first wall 12*a*, while the remaining press-fit openings 20 are located adjacent the second wall 12*b*. The staggered arrangement of press-fit openings 20 permit the electrical terminals 26 and 50 to be arranged so that the second ends 30*b* and 52*b* are staggered as best shown in FIG. 1. This staggered arrangement facilitates mounting the electrical connector 20 to the circuit board 11. Each of the electrical terminals 26 are inserted into terminal receiving passageways 18 having the press-fit opening 20 located adjacent to the second wall 12*b*. The second end 30*b* of the base arm 30 is guided through the press-fit opening 20 until the enlarged section 30*c* becomes press-fitted therein. The electrical terminals 50 are mounted in a similar fashion in terminal receiving passageways 18 having the press-fit opening 20 adjacent the first wall 12*a*. After the electrical terminals 26 and 50 are mounted in the terminal receiving passageways 18, the actuator 22 is slidably mounted on the insulating housing 12 so that the camming portion 24 (FIGS. 3 and 7) becomes operatively positioned at the mouth of actuator area 44.

As illustrated in FIGS. 3 through 5, the first and second camming surfaces 24*a* and 24*b* become operatively related to the engaging surfaces 36*a* and 38*a* and engaging surfaces 54*a* and 56*a*. It should be noted that as the camming portion 24 of the actuator 22 engages the engaging surfaces 36*a*, 38*a*, 54*a* and 56*a*, the insertion area 46 of each electrical terminal 26 and 50 becomes aligned in a home position in the insulating housing 12. In this regard, the spring sections 34 and 62 enables the actuator arms 32 and 51 to "float" in the terminal receiving passageway 18. When the electrical terminals 26 and 50 are in the home position, the insertion area 46 of the electrical terminals 26 and 50 become operatively aligned with the cable receiving opening 23.

As the actuator 22 is moved downward from the open position (FIGS. 3, 4 and 7) to the closed position (FIG. 5), the first and second camming surfaces 24*a* and 24*b* urge the first leg portions 36 and 54 toward the first wall 12*a*, and the second leg portions 38 and 56 toward the second wall 12*b*. The third leg portions 40 and 58 move in direct relationship with the movement of the first leg portions 36 and 54, respectively, so that when the first leg portions 36 and 54 are actuated towards the first wall 12*a* of the insulating housing 12, the third leg portions 40 and 58 also move towards the second wall 12*b*. It is to be noted that the second and third leg portions 38 and 40 of electrical terminal 26 and the second and third leg portions 56 and 58 of electrical terminal 50 are urged towards each other as the actuator 22 is moved downward and the camming portion 24 is inserted into the insertion area 44.

With the electrical connector 10 so assembled, the electrical connector 10 functions as a zero-insertion force connector, or ZIF connector as it is commonly called. When it is desired to interconnect the conductors 27 (FIG. 1) of a cable 28 to the traces on the printed circuit board 11, the electrical connector 10 is positioned so that the second ends 30*b* and 52*b* of the base arms 30 and 52, respectively, become aligned with through holes 11*a* on the printed circuit board 11. The electrical connector 10 is conventionally soldered to the circuit board 11 so that the second ends 30*b* and 52*b* of each electrical terminals 26 and 50, respectively, become conductively coupled to one or more traces on the circuit board 11. A cable 28 is then stripped to expose the conductors 27. The cable 28 may then be urged towards the electrical connector 10 such that the conductors 27 become operatively aligned with the cable receiving area 23 (FIG. 9). The conductors 27 are then urged into the insertion area 46 (FIGS. 2–5 and 7). It should be understood that the electrical connector 10 may be provided with any number of terminal receiving passageways 18, such that the number of passageways 18 corresponds to the number of conductors 29 in the cable 28.

As illustrated in FIG. 4, the cable 28 is inserted into the insertion area 46, and the conductor 27 becomes aligned with the engaging surfaces 38*b* and 40*a* of the second and third leg portions 38 and 40, respectively. The actuator 22 may be moved vertically downward (as viewed in FIGS. 3–5). This downward movement of the actuator 22 causes the engaging surfaces 38*b* and 40*a* of the second and third leg portions 38 and 40, respectively, to be urged towards each other and into contacting engagement (FIG. 5) with the conductor 27. The second and third leg portions 56 and 58 of the electrical terminals 50 also move into engagement with their associated conductor 27. With the cable 28 in the mounted position shown in FIG. 5, an electrical connection between the circuit on the circuit board and the cable 28 is achieved.

Advantageously then, the electrical connector 10 provides electrical terminals 26 and 50 which are capable of floating in their terminal receiving passageways 18, thereby permitting the electrical terminals 26 and 50 to become aligned in a predetermined location or home position by the actuator 22. Also, the electrical terminals 26 and 50 each comprise means for the actuator 22 to actuate a first set of legs which in turn causes a second set of legs to be actuated into engagement with the conductor 27 of the cable 28.

Various changes or modifications in the invention described may occur to those skilled in the art without departing from the true spirit and scope of the invention. The above description of the invention is intended to be illustrative only and not limiting, and it is not intended that the invention be restricted thereto but that it be limited only by the true spirit and scope of the appended claims.

What is claimed is:

1. A low insertion force electrical connector for interconnecting a foil circuit to a printed circuit board, said connector comprising an insulating housing carrying a plurality of electrical terminals and an actuator member, said terminal including a printed circuit board contact, a base portion, two contact arms and an actuator arm, the connector being characterized in that the actuator arm and two contact arms extend from the base arm by way of a spring arm portion, and in that the actuator member includes a camming wedge insertable between the actuator arm and one of the contact arms.

2. The connector of claim 1, characterized in that said actuator arm and one of said contact arms extend upwardly from a joining section.

3. The connector of claim 1, characterized in that said actuator arm and said other contact arm extend in a direction substantially parallel to one another.

4. The connector of claim 1, characterized in that said other contact arm extends integrally from the contact arm by way of a spring portion.

5. The connector of claim 4, characterized in that said other contact arm is positioned intermediate of said actuator arm and contact are.

6. An electrical terminal for use in an electrical connector for connecting at least one conductor from a foil cable to a circuit, said electrical terminal comprising a base arm, an actuator arm resiliently coupled to said base arm, said actuator arm comprising a first leg portion, a second leg portion, a third leg portion and a joining portion joining said first, second and third leg portions, said second and third leg portions defining an insertion area for receiving the foil cable, said terminal being characterized in that said first and second leg portions define an actuator area for receiving an actuator, and said second leg portion being resilient so that upon inserting an actuator into said insertion area said first and second portions are urged apart and said second and third portions are urged towards each other and into engagement with the at least one conductor of the foil cable.

7. The electrical terminal as recited in claim 6 characterized in that said electrical terminals are edge stamped from a sheet of conductive material.

8. The electrical terminal as recited in claim 6 characterized in that said first, second, and third leg portions are generally parallel to said, base arm.

9. The electrical connector comprising at least one terminal as recited in claim 6 characterized in that said electrical connector comprises a housing having a plurality of terminal receiving passageways for receiving a plurality of said electrical terminals, said housing having an upper surface and a mounting surface, said terminal receiving passageway defining an opening in said housing for receiving said electrical terminal (26, 50) and said actuator; said mounting surface having a press-fit opening associated with said terminal receiving passageway for receiving a solder leg of said terminal in order to secure said electrical terminal in said terminal receiving passageway, said solder leg protruding from said mounting surface to enable the electrical terminal to be mounted on a circuit board.

10. The electrical connector of claim 9, characterized in that the actuator includes camming surfaces which cam against edges of the first and second leg portions.

* * * * *